United States Patent [19]

Ashton

[11] 4,383,169

[45] May 10, 1983

[54] LUMINESCENT SCREEN DEVICES

[75] Inventor: John E. U. Ashton, Chelmsford, England

[73] Assignee: English Electric Valve Company Limited, Chelmsford, England

[21] Appl. No.: 43,470

[22] Filed: May 30, 1979

[30] Foreign Application Priority Data

May 30, 1978 [GB] United Kingdom ..... 23754/78

[51] Int. Cl.[3] ..... H01J 31/50; H01J 40/14

[52] U.S. Cl. ..... 250/213 VT

[58] Field of Search ..... 250/213 VT; 313/103 R, 313/104, 105 R, 106, 463, 473, 376, 489, 492, 507

[56] References Cited

U.S. PATENT DOCUMENTS 3,513,345 5/1970 Feaster ..... 313/104

3,665,247 5/1972 Gordon ..... 250/213 VT 4,002,938 1/1977 Pehe ..... 250/213 VT

*Primary Examiner*—Theodore M. Blum

*Attorney, Agent, or Firm*—Diller, Ramik & Wight

[57] ABSTRACT

The aluminium-backed phosphor layer on the output window of conventional image intensifier tubes of the photoemissive/luminescent screen type can be seriously damaged by the extremely high energy density pulse of electrons resulting from exposure of the tube to very bright light (such as a shell flash). The invention prevents or minimises the damage by placing in between and in contact with the phospher layer and the aluminium layer a layer of material (for example, potassium silicate) whose thermal properties are such as to cause it to act as a heat sink and so absorb most, if not all, of the thermal energy released by the electron pulse.

6 Claims, 2 Drawing Figures

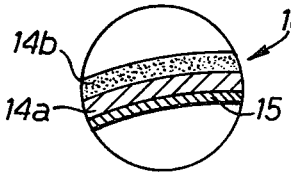
FIG. 2
FIG. 1
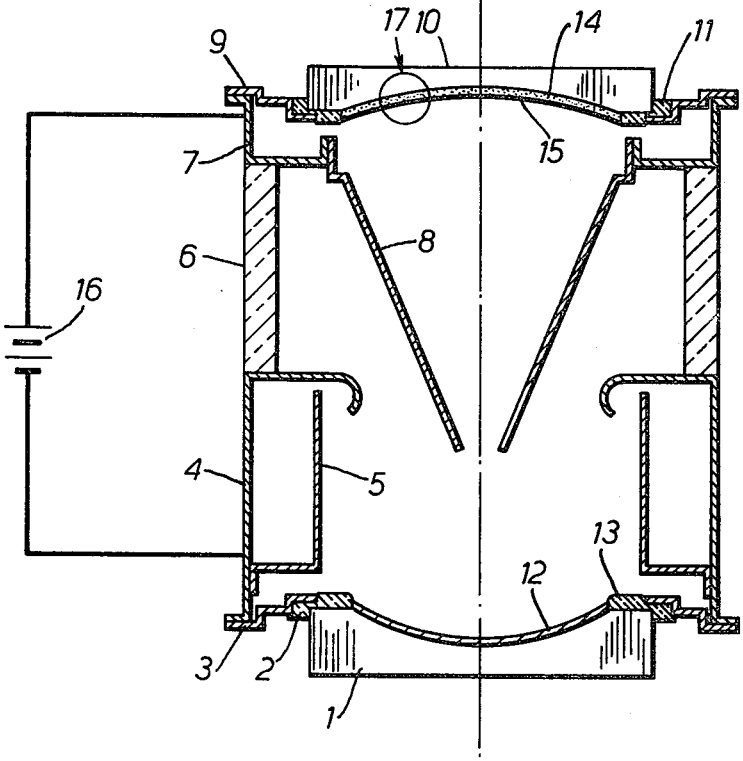

LUMINESCENT SCREEN DEVICES

This invention relates to luminescent screen devices and in particular to luminescent screen image intensifiers.

Typically an image intensifier consists of one or more stages each consisting essentially of a photo emissive cathode at an input end and a luminescent screen at the output end. Typically the luminescent screen consists of a phosphor layer having a backing layer of aluminium.

When such an image intensifier is exposed to very bright flashes of light a high energy density pulse of electrons is generated at the photo cathode, which can cause irreparable damage to the phosphor screen leaving this permanently scarred. Where the phosphor screen consists of a layer of phosphor with a backing layer of aluminium, quite commonly the energy density pulse of electrons causes the aluminium backing layer locally to melt.

One object of the present invention is to provide a luminescent screen device, and in particular a single or multi stage image intensifier, wherein the luminescent screen is to some extent protected from the effects of high energy density pulses of electrons impinging thereon.

According to this invention, a luminescent screen device is provided wherein the luminescent screen comprises a layer of luminescent material having in contact therewith a layer of material whose thermal properties are such that said last mentioned layer tends to act as a heat sink to absorb energy from high energy density pulses of electrons impinging thereon.

Where, as will usually be the case, said luminescent screen is provided with a backing layer of metal, such as aluminium, normally said heat sink layer will be provided between said luminescent layer and said backing layer of metal.

Preferably said heat sink layer is comprised of a silicate material, preferably potassium silicate.

Preferably said device is an image intensifier device having at one end a luminescent screen as described above and at the opposite, input, end a photo emissive cathode. Typically in such a case said device forms one module of a multi-state image intensifier.

In manufacturing a luminescent screen assembly for a luminescent screen device in accordance with the present invention a phosphor layer is first prepared by stand sedimentation, centrifuge-assisted sedimentation, electrophoresis, or the rubbing-in of phosphor into a thermo-setting binder, and, when said phosphor layer is set, a layer of silicate solution is applied via an atomiser spray.

Preferably the method of preparing said phosphor layer is a binder-free method, or one in which a binder consisting of an alkali silicate solution of strength approximating to 1.0% is utilised.

Preferably said silicate solution is potassium silicate solution in a preferred embodiment to strength 33%.

Preferably said potassium silicate solution is initially of specific gravity 1.33.

The invention is illustrated in and further described with reference to the accompanying drawing which illustrates a single stage image intensifier device in accordance with the present invention. The device illustrated may form one module of a multi stage image intensifier device.

In the drawing:

FIG. 1 is a sectional view of an image intensifier tube; and

FIG. 2 is an enlarged section of a portion of the luminescent screen represented at 17 in FIG. 1.

Referring to the drawing, FIG. 1, the device consists of a transparent input window 1, which, whilst the individual light fibres are not represented, is of the fibre optic type as known per se. The input window 1 is sealed by means of a glass frit seal 2 to a cathode input window mounting flange 3. The mounting flange 3 is carried from a cathode body housing 4. Electrically connected to the cathode body housing 4, and hence to the mounting flange 3, is a getter shield 5.

A ceramic body insulator 6 separates the cathode body housing 4 from an anode body housing 7. The anode body housing 7 supports an anode focusing cone electrode 8, as known per se. Mounted in an anode output window or screen mounting flange 9 is a transparent output window 10, which is of the fibre optic type, although again the individual optic fibres are not represented. The window 10 is scaled to the mounting flange 9 by another glass frit seal 11.

At one end of the tube and carried by the input window 1 is a photo-emissive cathode layer 12 provided with a peripheral photo cathode metal contact layer 13, the latter making electrical contact with the mounting flange 3.

At the output end of the device and carried by the output window 10 is a luminescent (phosphor) screen 14, which has an aluminium backing layer 15 electrically united with the mounting flange 9.

Operating potential difference is created between the housings 4 and 7 by means of a d.c. source represented at 16.

The portion 17 of the luminescent screen assembly 14/15 is shown to enlarged scale at 18 in FIG. 2. It will be seen that the photoemissive layer 14 is in two layers, referenced 14*a* and 14*b* respectively.

Layer 14*b* is of conventional form; it consists of fine grain particles of phosphor as known per se. Layer 14*a*, between layer 14*b* and the aluminium backing layer 15, consists of a silicate material having thermal properties such as to act as a heat sink.

In operation, the silicate layer 14*a* acting as a heat sink tends to absorb the thermal energy generated in the aluminium backing layer as a result of a high energy input pulse, and thus tends to prevent localized melting of this aluminium layer. At the same time the silicate layer 14*a* may be made sufficiently transparent to electrons as not seriously to interfere with the overall operation of the phosphor screen 14*b*, and the screen conversion efficiency and modulation transfer function remain substantially unaffected despite the resistance of the device to damage by high energy light flashes.

One method of manufacturing a luminescent screen assembly as described above will now be described.

The layer 14*b* is first formed using fine grain particles of phosphor of diameters between 1.0 and 3.0 μm in any convenient known manner, such as stand sedimentation, centrifuge assisted sedimentation, electrophoresis, or the rubbing-in of phosphor into a thermo-setting binder. The method by which the layer 14*b* is laid is not critical to the present invention, although preference is given to a binder-free method or one in which a binder consisting of alkali silicate solution of strength close to 1.0% is used.

Once laid, the layer 14*b* is permitted to set and dry before the layer 14*a* is formed. To form the layer 14*a*, a 33% strength silicate solution (volume by volume using an initial potassium silicate solution of specific gravity 1.33) is applied by means of an atomiser spray.

Once the layer 14*a* is set, the exposed surface is coated with a lacquer barrier layer, which is then followed by the evaporation of the aluminium layer 15 as known per se. The barrier layer of lacquer is subsequently removed by vaporisation as known per se.

I claim:

1. A light image-forming device of the sort wherein a source of electrons is stimulated to produce electrons which are then accelerated into contact with a luminescent screen which includes a layer of luminescent material constituting the electron-sensitive, light-emitting section thereof, which layer of luminescent material is provided with a backing layer of metal, so as to form a light image corresponding to the original stimulation of the electron source, wherein between and in contact with both said layer of luminescent material and said backing layer of metal is a layer of material whose thermal properties are such that it tends to act as a heat sink to absorb energy from high energy density pulses of electrons impinging thereon.

2. A device as claimed in claim 1 and wherein said backing layer of metal is aluminium.

3. A device as claimed in claim 1 and wherein the material forming said heat sink layer is a silicate.

4. A device as claimed in claim 4 and wherein said silicate is potassium silicate.

5. A device as claimed in claim 1 which is an image intensifier device and has at its output end said luminescent screen and at the opposite, input, end a photo emissive cathode.

6. A device as claimed in claim 5 and forming one module of a multi-stage image intensifier.

* * * * *